US007186025B2

(12) United States Patent
Shepard et al.

(10) Patent No.: US 7,186,025 B2
(45) Date of Patent: Mar. 6, 2007

(54) RECLOSABLE BAG WITH EXPANSION GUSSET

(75) Inventors: William H. Shepard, Amherst, NH (US); Gregory A. Carr, Nashua, NH (US)

(73) Assignee: Velcro Industries B.V., Curacao (AN)

( * ) Notice: Subject to any disclaimer, the term of this patent is extended or adjusted under 35 U.S.C. 154(b) by 0 days.

(21) Appl. No.: 10/662,266

(22) Filed: Sep. 15, 2003

(65) Prior Publication Data

US 2004/0131285 A1 Jul. 8, 2004

Related U.S. Application Data

(63) Continuation of application No. PCT/US02/08055, filed on Mar. 15, 2002.

(60) Provisional application No. 60/276,567, filed on Mar. 15, 2001.

(51) Int. Cl.

| | |
|---|---|
| ***B65D 30/20*** | (2006.01) |
| ***B65D 33/10*** | (2006.01) |
| ***B65D 33/16*** | (2006.01) |
| ***B65D 30/16*** | (2006.01) |
| ***B65D 33/00*** | (2006.01) |

(52) U.S. Cl. ..... 383/120; 383/9; 383/61.2; 383/104; 383/203

(58) Field of Classification Search ..... 383/104, 383/120, 61.2, 204, 63, 9, 203
See application file for complete search history.

(56) References Cited

U.S. PATENT DOCUMENTS

| | | | | |
|---|---|---|---|---|
| 4,912,616 | A * | 3/1990 | Van Erden | 383/65 |
| 5,065,899 | A * | 11/1991 | Tilman | 221/305 |
| 5,682,730 | A | 11/1997 | Dobreski | |
| 6,007,244 | A * | 12/1999 | Dinder | 383/24 |
| 6,148,588 | A | 11/2000 | Thomas et al. | |
| 6,213,641 | B1 * | 4/2001 | Price | 383/63 |
| 6,361,209 | B1 * | 3/2002 | LaRue et al. | 383/10 |
| 6,416,221 | B2 * | 7/2002 | Price | 383/63 |
| 6,481,183 | B1 * | 11/2002 | Schmidt | 53/412 |
| 2004/0114838 | A1 * | 6/2004 | McGregor | 383/204 |

FOREIGN PATENT DOCUMENTS

| | | | | |
|---|---|---|---|---|
| JP | 03240651 | | 10/1991 | |
| JP | 5-147661 | * | 6/1993 | 383/63 |
| WO | WO 99/10246 | | 3/1999 | |
| WO | WO 00/27721 | | 5/2000 | |
| WO | WO 00/73052 | | 12/2000 | |
| WO | WO 01/17864 A2 | * | 3/2001 | 383/63 |
| WO | WO 02/06130 | | 1/2002 | |

* cited by examiner

*Primary Examiner*—Jes F. Pascua
(74) *Attorney, Agent, or Firm*—Fish & Richardson P.C.

(57) ABSTRACT

A reclosable bag has opposing broad face panels defining a volume therebetween for holding a quantity of contents, an end of the body forming an expandable gusset between the broad face panels, and a reclosable bag closure between the expandable gusset and a corresponding edge region of one of the broad face panels. When the closure is opened, a bag opening is formed between the expandable gusset and said one of the broad face panels of the bag, to access the bag contents. In one example, the bag has upper and lower expandable gussets, while in another the bag has expandable side gussets. The closure is readily closed without precise alignment and despite the adjacent gusset.

28 Claims, 9 Drawing Sheets

RECLOSABLE BAG WITH EXPANSION GUSSET

CROSS-REFERENCE TO RELATED APPLICATION

This application is a continuation under 35 U.S.C. §120, of PCT/US02/08055, filed Mar. 15, 2002, which claims priority to U.S. Provisional Application No. 60/276,567 filed Mar. 15, 2001.

TECHNICAL FIELD

This invention relates generally to reclosable bags, and to methods of making and filling such bags.

BACKGROUND

Convenience packaging, particularly for foodstuffs and bulk materials, frequently involves the use of bags or pouches. These bags can be advantageously constructed with side or bottom gussets to make them able to be set upright on a horizontal supporting surface, for filling, display or storage. It is common to refer to bags with bottom expansion panels and sealed side and top edges as 'pouches'.

More recently, bags have been produced with expansion panels at both top and bottom, and vertical side seals. Examples of these bags are marketed under the trade name "Flex-Can", for example, and are known for their ability to be conveniently stacked one on top of another, like cans. Both the top and bottom panels of these bags expand substantially and simultaneously as the bags are filled, such that the sides of the bag separate at both top and bottom, in some cases remaining generally parallel and vertical. As filled, the bag and its contents can exhibit significant structural stability, enabling stacking and convenient handling, with very little head space above the contents.

SUMMARY

We have realized that it is possible to equip a gusseted bag with a reclosable seal adjacent its gusset and have the closure function despite the expansion and contraction of the gusset.

SUMMARY

We have realized that it is possible to equip a gusseted bag with a reclosable seal adjacent its gusset and have the closure function despite the expansion and contraction of the gusset.

The invention features a reclosable, gusseted bag, having an opening defined adjacent an expansion gusset.

According to one aspect of the invention, a gusseted bag has a body with opposing broad face panels defining a volume therebetween for holding a quantity of contents, an end of the body forming an expandable gusset between the broad face panels, and a reclosable bag closure between the expandable gusset and a corresponding one of the adjacent edge regions of one of the broad face panels, such that when the closure is opened a bag opening is formed between the expandable gusset and said one of the broad face panels of the bag, to access the bag contents.

In some embodiments, the body has two opposing gussets between the broad face panels on opposite ends of the bag, the bag closure being disposed adjacent one of the gussets. The opposing gussets may be disposed at top and bottom ends of the bag, for example, with the bag constructed to rest on its bottom end when filled. Or the bag may be constructed to rest on a bottom end when filled, with the two opposing gussets disposed along opposite vertical sides of the bag, as another example.

In some preferred cases, the gusset and closure are disposed at a top end of the bag with the bag standing on its bottom end. In other preferred cases, the gusset and closure are disposed along a vertical side edge of the bag with the bag standing on its bottom end.

In preferred constructions, the bag closure comprises a mechanical touch fastener. In some cases, other closure technologies may be employed, however, such as adhesives. The presently preferred bag closure has elongated, mating bands of hooks, hook-engageable fibers, and a unitary strip-form base along which the mating bands extend in parallel. The base may define a frangible burst membrane between the mating bands, with the membrane arranged to be breached to gain initial access to the bag contents. For some applications, the burst membrane is disposed inboard of the mating bands. To form an advantageous anti-peel flap, for example, one longitudinal side of the closure may be attached to the bag body only outboard of the mating bands. That one longitudinal side of the closure may be disposed adjacent the outer broad face panel of the bag, with an opposite longitudinal side of the closure being secured to the gusset.

According to another aspect of the invention, an open bag suitable for filling with contents and sealing after filling is provided. The bag includes a body having an open end, two opposing, broad face panels defining a volume therebetween for holding a quantity of contents, and a flap attached to one of the broad face panels along the open end, the flap having an inwardly-facing fold for forming an expandable gusset between the broad face panels after the open end is sealed. The bag also includes a reclosable bag closure secured to a free edge of the flap and defining one side of a fill opening at the open end of the bag.

In some embodiments, the bag closure comprises two separate closure strips. One of the strips is secured to the free edge of the flap, and the other of the strips is secured to a free edge of an opposing one of the face panels, the two strips together forming an overlapping touch closure and defining the fill opening therebetween.

In some cases the bag body includes two opposing weld flanges outboard of the bag closure and exposed to be sealed together after filling. One of the weld flanges extends along the free edge of the flap and the other weld flange extends along a free edge of one of the face panels. The bag body can be provided with a frangible tear line along an inboard edge of at least one of the weld flanges, for tearing the weld flanges from the bag to access the contents after filling, for example.

For some applications, the bag also has a wicket extension along a free edge of one of the face panels outboard of the closure, the wicket extension defining at least one hole therethrough.

In some embodiments, the bag closure comprises a unitary, folded strip carrying opposing bands of mating touch fastener elements on a front face thereof, a back face of the folded closure strip defining said one side of the fill opening.

The flap extends between sealed edges of the bag in some applications, to form a full-length gusset. The bag closure may also extend between the sealed edges of the bag. The bag body also forms an expandable gusset on a side of the bag opposite the flap and bag closure, in some embodiments. In some cases, the bag is constructed to rest on a bottom end thereof when filled, with the flap and closure disposed at a top end of the bag. In other cases, the bag is constructed to rest on a bottom end thereof when filled, with the flap and closure disposed along a vertical side edge of the bag with the bag standing on its bottom end.

According to another aspect of the invention, a method of forming fillable, reclosable bags is provided. The method includes attaching a bag closure strip along one longitudinal edge of a length of bag film, and forming from at least the length of bag film a bag having an open end, two broad, opposing faces and a flap with an inwardly-extending fold. The flap is attached to an edge of one of the broad faces along the open end and extending between sealed edges of the bag, with the open end of the bag defining a fill opening between the closure strip and the other of the broad faces of the bag.

In some embodiments, the closure strip comprises an elongated strip-form base with two spaced-apart, parallel, mating bands of fastener elements disposed on a common face of the base. The base is folded along its length between the bands of fastener elements to maintain the fastener elements in engagement while the bag is being formed. One of the mating bands of fastener elements may include hooks, for example, with the other of the mating bands of fastener elements including hook-engageable fibers. In some cases, mutually engaging arrays of headed projections may be employed for the two bands of fastener elements. The band with fibers may include a non-woven web of fiber. In some cases, forming the bag includes folding the length of bag film to form both broad face panels and the flap.

Preferably, the bag is formed after the closure strip is attached to the bag film. However, the closure strip may alternatively be attached after or during bag formation. In some preferred constructions, the closure strip extends across the bag between the sealed edges of the bag.

Forming the bag includes, in some embodiments, cutting the length of film and the bag closure strip to selected lengths after the bag closure strip is attached, and sealing cut ends of the film and closure strip to form the sealed edges of the bag.

According to another aspect of the invention, a method of filling and sealing a reclosable bag is provided. The method includes providing a bag with a body having an open end, two opposing, broad face panels defining a volume therebetween for holding a quantity of contents, and a flap attached to one of the broad face panels along the open end, the flap having an inwardly-facing fold for forming an expandable gusset between the broad face panels after the open end is sealed, and a reclosable bag closure secured to a free edge of the flap and having an exposed side defining one side of a fill opening at the open end of the bag; filling the bag with contents through the fill opening; and sealing the exposed side of the closure strip to the other of the broad face panels of the bag, to permanently close the fill opening.

According to yet another aspect of the invention, a method of forming, filling and sealing reclosable bags is provided. The method includes attaching a bag closure strip along one longitudinal edge of a length of bag film; forming from the length of bag film a bag having, two broad, opposing faces and an expandable gusset between the broad faces adjacent the closure strip; filling the bag with a quantity of contents; and forming a seal along an edge of the bag between the broad faces and crossing the closure strip at one end of the expandable gusset, to seal the filled bag. This method is preferably performed in a vertical orientation.

The closure strip is preferably constructed to be folded along a region between the bands of fastener elements and loops to place these bands in releasable engagement. Preferably, the fastener elements are integrally molded with resin of the substrate. In some embodiments, the loop strip comprises a non-woven web of entangled fibers forming the loops and having a basis weight of less than about 4 ounces per square yard (preferably, less than about 2 ounces per square yard). In some cases, the non-woven web comprises a needled web in a stretched condition.

In some presently preferred embodiments, the substrate defines a groove extending longitudinally along the length of the closure strip between the band of loops and the band of fastener elements. This groove is preferably lengthwise continuous and defined by molded surfaces in the front face of the substrate.

The back face of the substrate is preferably void of fastener elements and loops, for permanently adhering the substrate to the sides of the bag. Regions of the back face may be covered with a layer of adhesive for permanently attaching the closure strip to opposite sides of a bag, or comprise exposed resin of the substrate, for permanently welding the closure strip to opposite sides of a bag formed of a compatible material.

In some embodiments of the bag, the closure strip of the bag includes a peelable adhesive seal for resealing the bag after initial opening. In some cases, this peelable seal also functions to secure the open end of the bag against inadvertent opening.

In some embodiments, the substrate of the closure strip is permanently affixed to the side walls of the bag body with adhesive. In some other embodiments, the substrate of the closure strip is welded to the side walls of the bag body. The substrate of the closure strip and the side walls of the bag body may both be formed of polyethylene, for instance.

The bag of the invention is constructed both for ready reclosure and for expansion, obtaining many of the benefits of expandable gusset bags (such as the ability to stand unsupported during storage and display, and to adapt to various fill levels) while also providing for convenient (in some cases, one-hand) reclosure. The mating closure strip bands can be made relatively wide, for easy alignment despite the conformance of the adjacent, expandable gusset. The closure can be placed inside the bag, attached directly to the expansion gusset panel, without requiring additional flaps. The closure can incorporate hook and loop engagement to provide necessary ventilation for some applications. Such hook and loop closures are also able to accommodate a fair amount of dirt or debris without losing their function as closures, making bags of this construction particularly applicable for containing granular or powder substances. In addition, the natural porosity of hook and loop closures can provide some degree of filtering of airborne dust. Such a ventilated closure can be particularly desirable in cargo containers of airplanes in order to accommodate pressure changes, and, by its venting action, may help to avoid moisture buildup to keep produce and other such items fresh. The closure can be readily provided with a central burst membrane to maintain an air-tight seal until the bag is initially opened.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
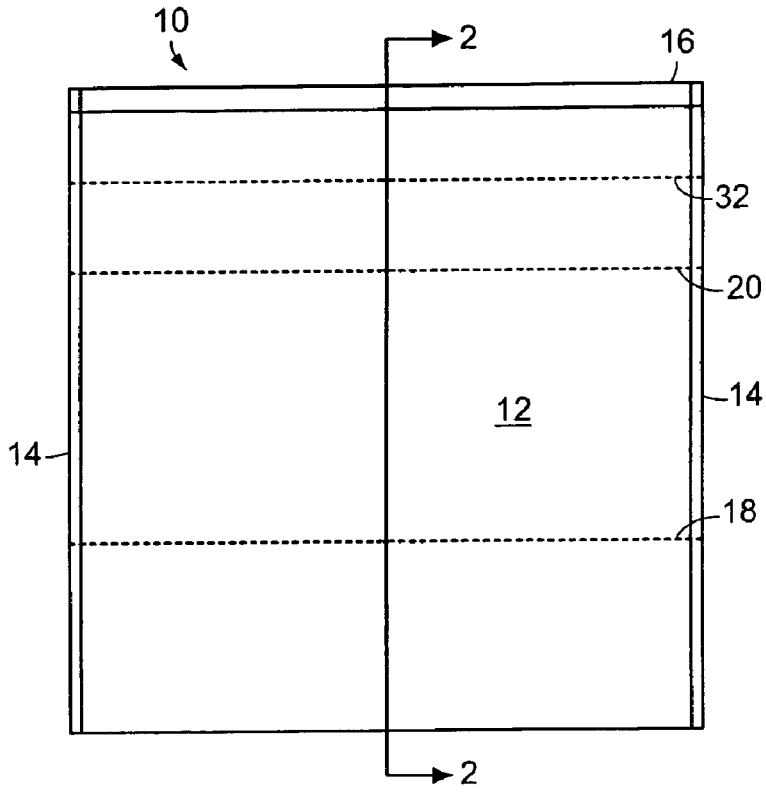
FIG. 1 is a side view of an empty, open bag.

The disposable, reclosable bag 10 of FIG. 1 has two broad face panels (front panel 12 is fully visible in this view, with only the upper edge portion of rear panel 16 in view) formed of a single, folded sheet of polyethylene film sealed along side edges 14. Bag 10 is suitable for packaging bulk granular or powdered products, such as consumable foodstuffs, animal feed, fertilizers, cleaners and the like, for retail sale.

Figure 2:
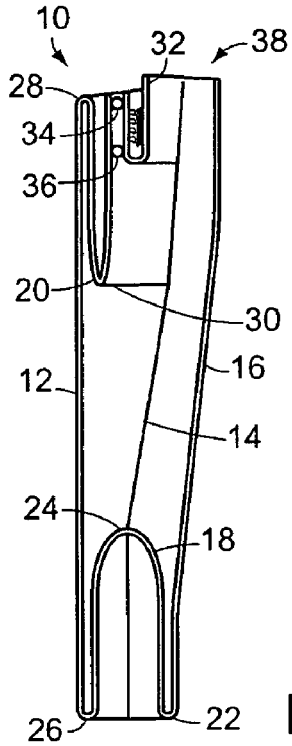
FIG. 2 is a cross-sectional view of the bag, taken along line 2—2 in FIG. 1.

Referring also to FIG. 2, bag 10 is formed to have a bottom gusset 18 folded inwardly from the bottom edges of front and rear panels 12, 16 and extending across the full length of the bag between side seals 14. The upper edge of front face 12 is folded over twice to form an inwardly extending top gusset 20. Thus, in this embodiment, a single continuous sheet of bag film is longitudinally folded along five parallel lines corresponding to corners 22, 24, 26, 28 and 30. To help maintain the sharpness of folds 22, 26 and 28, these folds are creased and may even be set by thermal sealing or other means. Gusset folds 24 and 30 are not creased in this example, but can be to enable pre-made bags to be folded flat.

A reclosable closure strip 32 is attached along the free edge of upper gusset flap 20, such as by continuous thermal welds along two spaced apart, longitudinal regions 34 and 36. Adhesives or other attachment means may also be employed. The closure strip is folded along its center between mating bands of hooks and loops, with the hooks and loops initially engaged to hold the closure in its folded state before the bag is filled. Thus, a fill opening 38 is defined between the exposed face of closure strip 32 and the inner surface of back face panel 16. The closure strip and fill opening 38 extend across the length of the bag between the side seals, where the closure strip is sealed between the front and back face panels.

Figure 3:
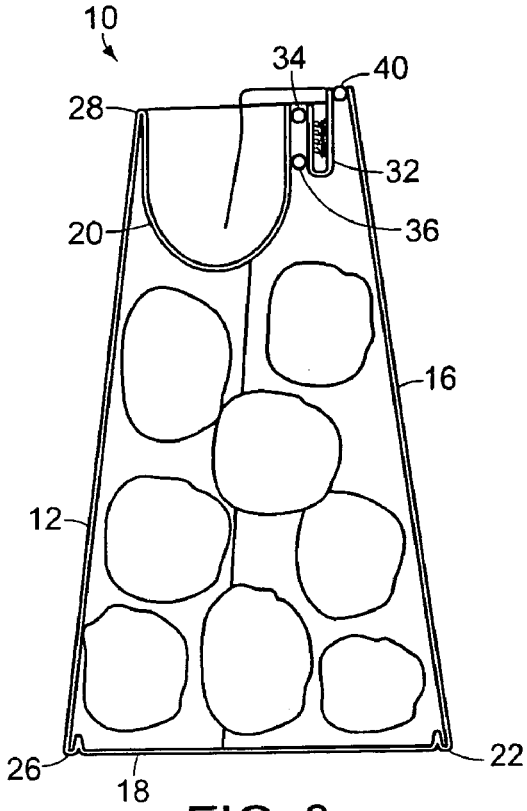
FIG. 3 shows the bag after filling and sealing.

Once the bag has been filled with desired contents (FIG. 3), the outer, free edge of closure strip 32 is sealed to back face panel 16 across the entire length of the bag, forming seal 40 that seals the bag for storage, shipment and retail display. As the bag is filled, upper and lower expansion gussets 18 and 20 expand, such that the central vertical cross-section of the bag has a generally trapezoidal structure, and the interior volume of the bag has swelled to accommodate the contents. In some cases (see also FIG. 5, for example), upper gusset 20 expands substantially as much as does bottom gusset 18, such that front and rear face panels 12 and 16 remain generally vertical and parallel. The expanded bottom gusset 18 forms a stable base upon which the filled bag may be readily balanced, and by also expanding upper gusset 20, the side panels of the bag bow outward with enhanced structural stiffness along the entire height of the bag, for supporting loads from above. With finer-grained contents (such as bird seed, for example), much of the load-supporting ability is provided by the constrained contents themselves, with the upper and lower gussets enabling the bag to conform to a more block-like structure under the pressure of the weight of the contents. This bag structure is also suitable for containing liquids, although for many such applications a non-venting closure means will be desired, either by providing the touch fastener closure with an auxiliary seal or by employing a cohesive closure. In general, face-type closure means are preferred for ease of closure with little alignment, but for some applications some types of rib and groove closures, such as self-aligning or multi-rib constructions, for example, may also be employed adjacent a gusset.

Figure 4:
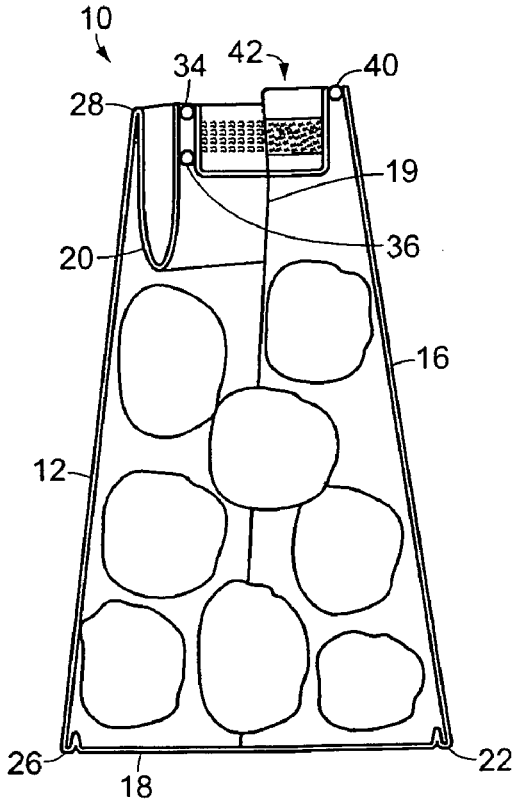
FIG. 4 shows the bag after initial opening.

To initially open the bag (FIG. 4), the gusset side of closure strip 32 and the upper edge of back panel 16 are grasped in separate hands, and pulled laterally away from each other to burst through the longitudinal frangible region running along the central portion of closure strip 32 between the mating fastener bands and form an access opening 43 along the upper end of the bag between the two sides of the closure strip.

Advantageously, bag 10 can be reclosed between uses, such as for post-sale storage. To reclose the bag, one need only bring the exposed faces of closure strip 32 back into facial contact to engage the mating fastener bands. Although it might be expected that the tension in adjacent gusset 20 and the resulting non-parallelism of the two separated sides of the closure strip would make reclosure difficult, we have found that with a facial contact closure the two sides of the closure can be readily brought into useful engagement because only very minimal alignment and contact pressure is required. The bag may be reclosed and reopened a fair number of times to regain access to the bag contents. Furthermore, with hook-and-loop closure technology the once-opened closure provides an integral air and gas vent, such as is known to be useful for vegetables and certain other perishable bag contents.

Figure 5:
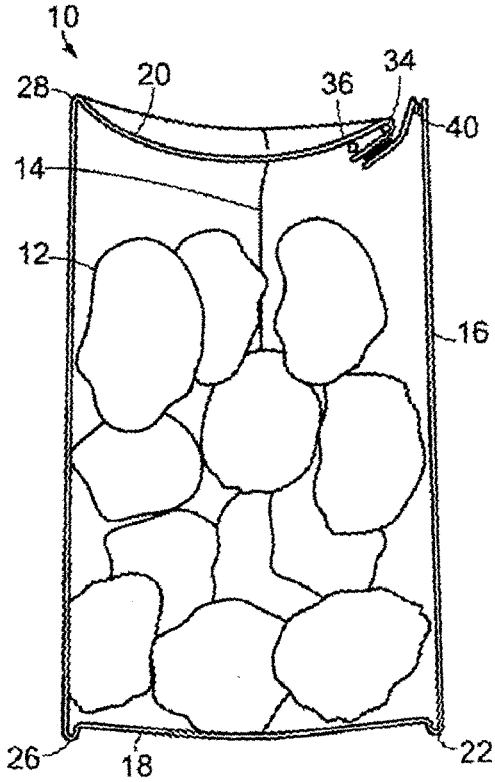
FIG. 5 shows such a bag after reclosing, and filled to a greater extent.

By sealing one side of closure strip 32 only along an outer edge region 40, the lower width of the closed closure strip is able to flex away from the adjacent side 16 of the bag, as shown in FIG. 5. The flexibility of the thin resin base of the closure strip 32 also enhances its ability to align the mated fastener bands with the direction of any separating load applied to the closure 32 by tension in the adjacent gusset 20, thus tending to develop shear loads across the mated fastener bands rather than peel forces that would more readily lead to inadvertent opening at higher fill levels.

Figure 6:
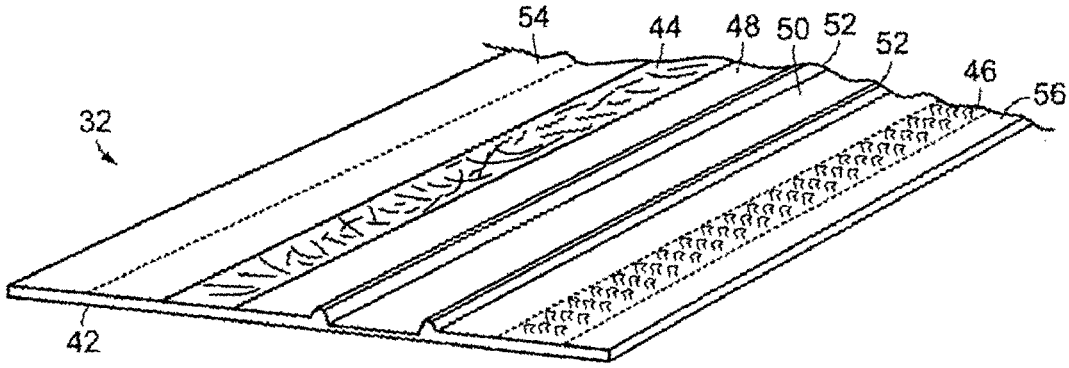
FIG. 6 is an enlarged perspective view of the closure strip, laid flat.
Figure 7:
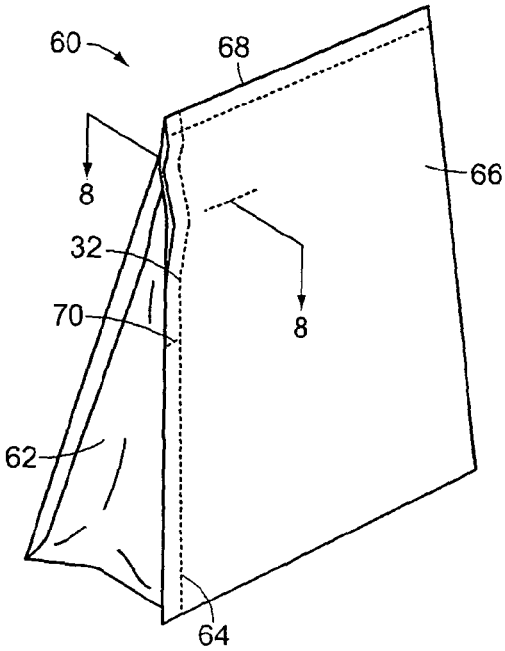
FIG. 7 is a perspective view of a filled, sealed bag with a side closure.

Referring now to FIG. 6, lengthwise-continuous closure strip 32 consists of a thin, sheet-form resin substrate 42 (of polyethylene, for example) with lengthwise-continuous, parallel bands 44 and 46 of loops and fastener elements, respectively, on its front face 48. Bands 44 and 46 are equally spaced from a central groove 50 of the closure strip, such that when the strip is folded longitudinally at groove 50 to cover front face 48, the fastener elements of band 46 engage and retain the loops of band 44 to form a releasable fastening. Preferably, the thickness of the substrate of the closure strip is about the same as the thickness of the material of the bag body, in the range of 0.002 to 0.005 inch. The fastener elements 52 of band 46 are integrally molded with and extend from front face 48. In this embodiment, these fastener elements are in the form of J-hooks that extend, in rows, along the length of the closure strip. Some of the J-hooks face in opposite directions along the strip. Other fastener element shapes may also be employed, including those that overhang the substrate 42 in a widthwise direction. A suitable fastener element shape is the CFM29 hook shape (of about 0.015 inch in height), available in various products sold by Velcro USA in Manchester, N.H.

Band 44 of loops consists of a preformed, non-woven web of polymer fibers, which may include a stabilizing binder, and which are bonded to front face 48 of substrate 42 at various points across the width and length of the web. Suitable loop materials include those disclosed in U.S. Pat. Nos. 6,342,285 and 6,329,016, the entire disclosures of which are hereby incorporated by reference as if fully set forth. Other useful loop materials include some low cost knits, such as ACRI Industrial Termofijado Knit Loop 4211A99999, available from Tybor S. A. of Girona, Spain.

Closure strip 32 may be produced by the method disclosed in U.S. Pat. No. 6,202,260, and may incorporate other features disclosed in said patent, the entire disclosure of which is also hereby incorporated by reference as if fully set forth. Some suitable methods also employ features of the nip-molding and in-situ laminating concepts disclosed in U.S. Pat. Nos. 4,794,028 and 5,260,015, the details of both of which are also incorporated herein by reference.

Closure strip 32 has an overall width of about 2.5 inches (64 millimeters) and a nominal thickness of about 0.004 inch (0.1 millimeter). Loop and hook bands 44, 46 each have a width of about 0.75 inch (19 millimeters). In another preferred embodiment they have widths of about 0.5 inch (12.5 millimeters), as selected for desired peel resistance. Groove 50 is 0.002 inch (0.05 millimeter) deep and extends over a width of about 0.125 inch (3.2 millimeter). Thus, at groove 50 the closure has a reduced thickness of only about 0.002 inch (0.05 millimeter). On either side of groove 50, tear-limiting ribs 52 rise another 0.002 inch (0.05 millimeter) from the nominal surface of the closure base to resist propagation of tears from groove 50 into either of the fastener bands. Unitarily molded rip-stop features (not shown) may also be included on either side of groove 514 throughout the area of the closure separating the hook and loop bands to help resist tear propagation. The remaining width of the closure strip forms a flange 54 outboard of the band 44 of loops, and a narrower flange 56 outboard the band 46 of fastener elements, for welding or otherwise attaching the closure strip to the bag material.

Although the illustrated, preferred embodiments employ hook-and-loop fastening means, other face-contact closures that do not require precise feature alignment are also suitable, such as peelable adhesives, inter-engaging arrays of mushroom-type structures that are engageable in several relative positions, and other similar closure means.

Referring next to FIGS. 7–10, another bag 60 has two opposing side expansion gussets 62 (one hidden from view) and a bottom expansion gusset. Bags of such overall structure may be formed by any of a number of known methods, such as by welding together individual panels or groups of panels along various side, top and/or bottom edge seals. The illustrated bag has a vertical side seal 64 joining one of the side gussets 62 to face panel 66. Extending from the upper edge 68 of bag 60 only partially along seam 64 is a reclosable closure strip 32 incorporated into seam 64. Along the length of closure strip 32, the adjacent side gusset 62 is sealed to one outer side of the folded closure strip, with face panel 66 sealed to the other outer side of the folded closure strip (see FIG. 8). In this case, both sides of the closure strip are secured by welds over a relatively wide width behind the fastener bands. One end of the closure strip is sealed at the upper edge 68 of the bag, and the other end 70 of the closure strip is sealed within side seal 64, such that the filled bag is initially sealed for transport and retail display.

Figure 9:
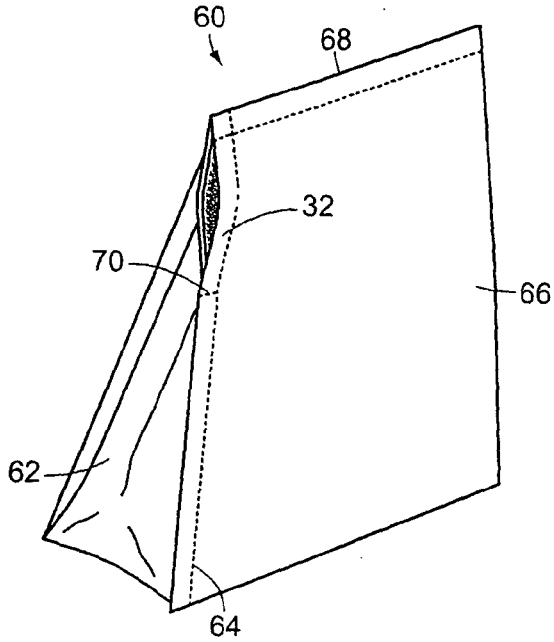
FIG. 9 shows the bag of FIG. 7 after initial opening.
Figure 8:
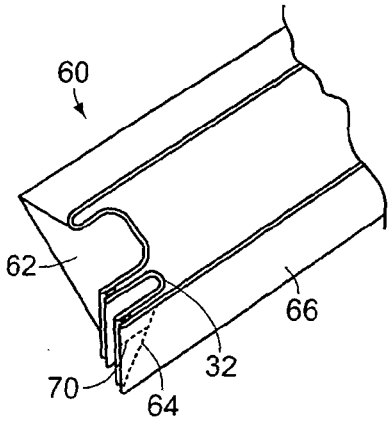
FIG. 8 is a cross-sectional view, taken along line 8—8 in FIG. 7.
Figure 10:
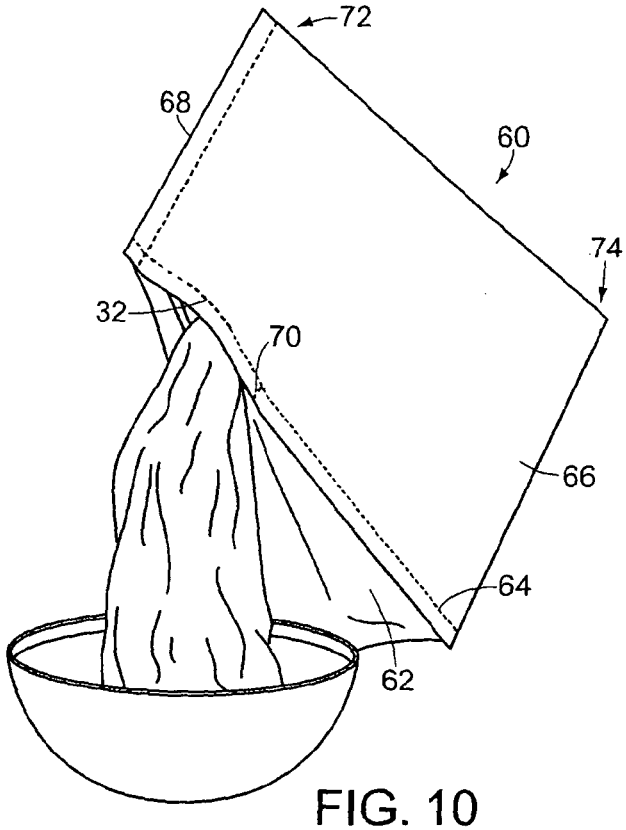
FIG. 10 illustrates pouring contents of the bag of FIG. 7 through the open side closure.

After sale, the closure strip can be pulled open, as shown in FIG. 9, to burst through the inner membrane of the closure strip and open the bag. Once open, the location of the closure strip along the upper vertical edge of the bag is useful for pouring out the contents of the bag in desired amounts. The upper corner 72 of the opposing side wall gusset forms a convenient handle for inserting one or more fingers to help lift and tilt the bag for pouring, with perhaps another hand grasping the bottom gusset panel edge 74. The weight of the product during pouring can act to expand the side gusset to minimize trapping product behind the gusset. After use, the user need only squeeze the side opening of the bag closed to re-engage closure 32 for post-use storage. As in the embodiment of FIGS. 1–5, the closure is relatively easy to manipulate and re-engage despite the existence of the adjacent expansion gusset.

Figure 11:
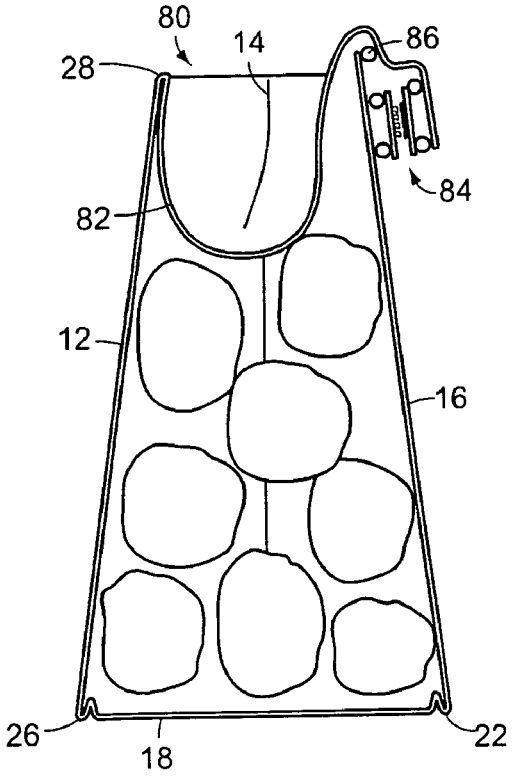
FIG. 11 shows a bag with an upper expansion gusset that extends over one upper edge of the bag.

Referring now to FIG. 11, bag 80 is equipped with a top expansion gusset 82 that extends from upper corner 28 of face panel 12 over the upper edge of face panel 16, and is secured to the outer face of the bag as shown. In this instance, the reclosable closure 84 is in the form of two separate strips, one carrying a band of hooks and the other a mating band of loops, such that the closure itself performs no pre-entry seal function. Instead, upper gusset 82 is secured to the upper edge of face panel 16 by a reclosable, pressure-sensitive seal 86 to help preserve content freshness even after the initial opening of the bag.

Figure 13:
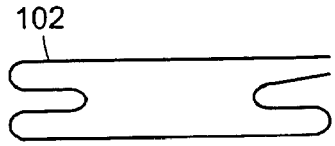
FIGS. 13–15 are cross-sectional views, taken along lines 13—13, 14—14 and 15—15, respectively, in FIG. 12.
Figure 14:
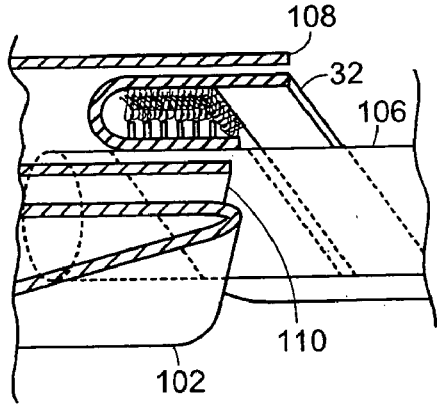
Figure 15:
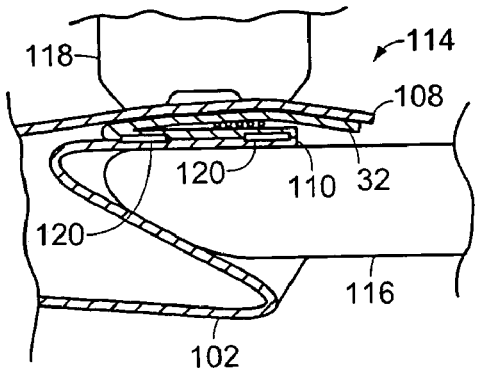
Figure 12:
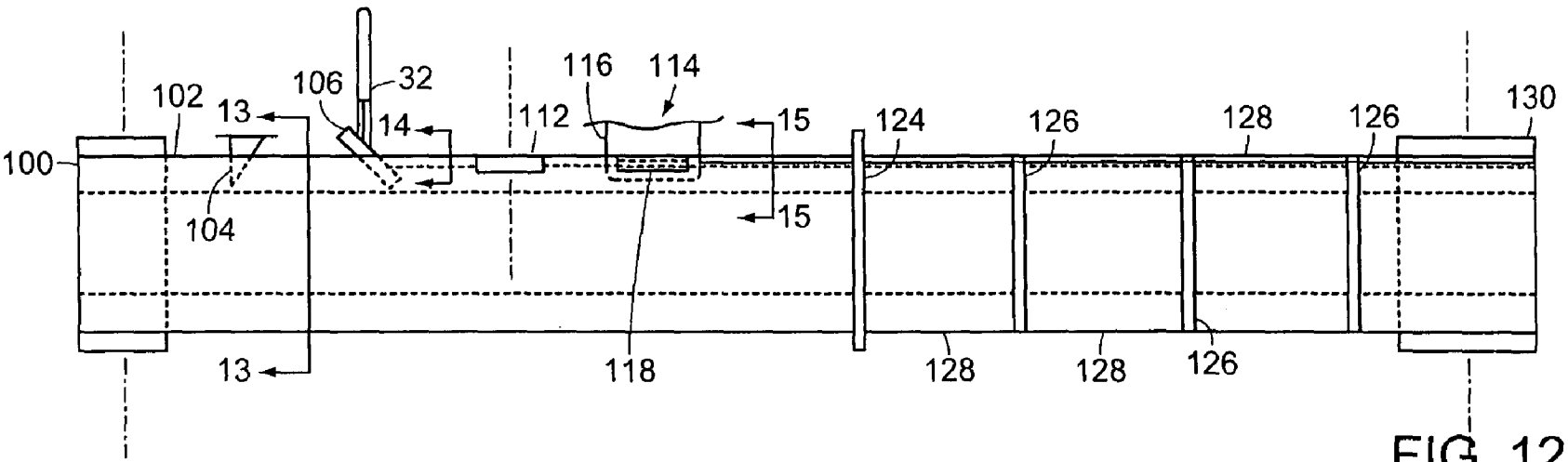
FIG. 12 illustrates a method and apparatus for forming bags.

Referring now to FIG. 12, bags 10 are formed from a continuous tube 102 of bag film from roll 100. Film 102 is pre-folded to have two longitudinal, folded gussets. Alternatively, the bag-forming process can begin with a flat sheet of bag film that is then folded around a V-board with side gusseters. One edge of the tube, adjacent one of the two gussets, is slit by blade 104 to form a slit tube (FIG. 13). Next, a continuous closure strip 32 is introduced into the slit around angled bar 106 (FIG. 14), with the longer side of the strip aligned with the outer edge 108 of the tube and the shorter side of the strip aligned with the inner edge 110 of the tube adjacent the gusset. Next, the closure strip 32 and slit tube 102 are passed between two nip rollers 112 (only one shown) to maintain alignment of the bag film and closure strip until sealing. The closure strip and bag film are then passed through a sealing station 114 where a stationary anvil 116 slides along the adjacent gusset, providing a support surface for heated sealing shoe 118. Shoe 118 engages the outer surface of the bag film opposite the closure strip along two parallel regions. Heat from the shoe is conducted through the bag film and closure strip to heat seal the back side of the closure strip to the layer of bag film against anvil 116, to form permanent seals 120 that secure one side of the closure strip to the bag film, with the other side of the closure strip remaining unattached to the outer edge of the bag film tube.

Figure 16:
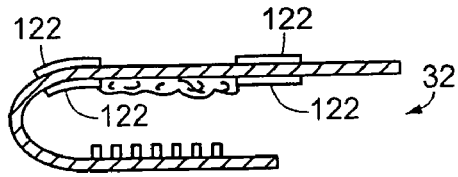
FIG. 16 is a cross-sectional view of a folded bag closure strip.

Referring also to FIG. 16, longitudinal zones of closure strip 32 are coated with an anti-weld coating 122, such as a flexographic overprint that functions to resist sealing adjacent surfaces together in such coated zones as the closure strip and bag film pass through sealing station 114. Suitable coatings include Matte Imprintable Overprint No. AWX5-92105-401, available from Arcargraphics of West Chicago, Ill. The coated anti-weld zones may be ⅛ inch to 3/16 inch (3 to 5 millimeters) in width, with a nominal coating thickness of 0.001 inch (0.025 millimeter), for example.

Still referring to FIG. 12, the closure strip and bag film next pass between an opposing pair of transverse sealing bars 124 (again, only one is shown) that repeatedly come together to seal the bag film together under heat and pressure to form transverse seals 126 connecting adjacent bags 128. The series of connected bags is then spooled on roll 130 for later filling and sealing. Alternatively, sealing bars 124 may be adapted to both seal the bag film and separate the tube into individual bags that can be stacked or wicketed. Also, instead of spooling the bags, the series of connected bags can immediately enter filling and sealing stations to produce individual, filled bags.

Figure 17:
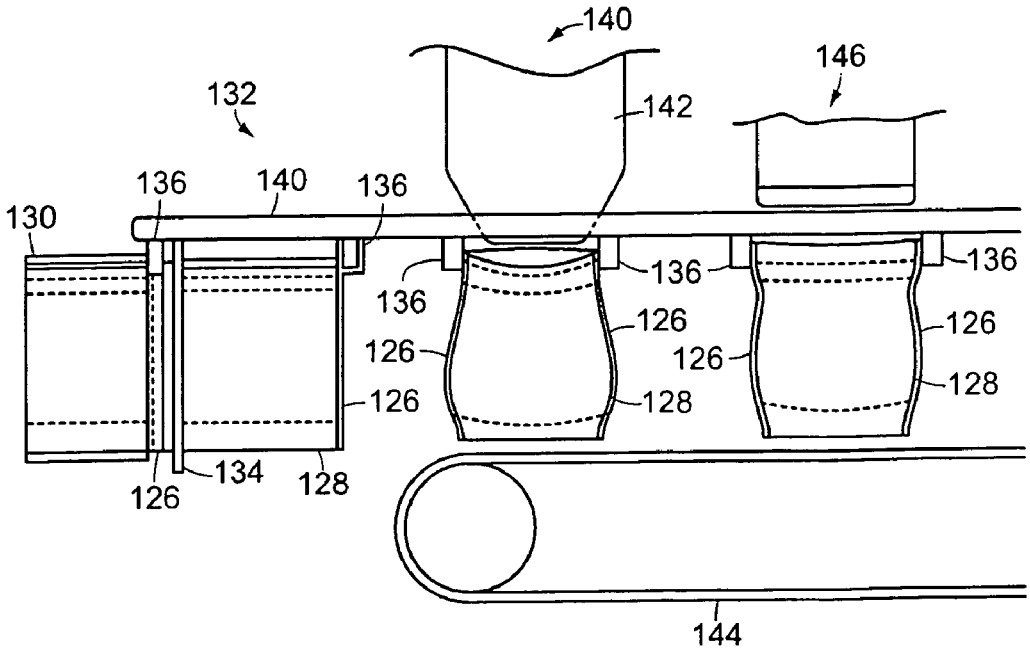
FIG. 17 illustrates a method and apparatus for filling and sealing bags.

Referring now to FIG. 17, a roll 130 of seriatim bags is unspooled into a filling and sealing machine 132. The bag film and attached closure strip are severed within each transverse seal 126 by cutting bar 134 to separate the individual bags 128. The bags are each held by clamps 136 that move along track 138 to transport the empty bags to filling station 140, where they are filled with a selected quantity of contents dispensed through chute 142. As they approach the filling station, the distance between the two clamps 136 holding each bag is reduced to help enable the opening of the upper end of the bag for filling. During filling, the lower end of the filling bag is allowed to rest at least partially on an indexed conveyer 144. Next, the filled bag moves on conveyer 144 to a top sealing station 146 where the two clamps 136 holding the upper corners of the bag within the side seals 126 are moved apart from each other to apply tension along the bag opening as a heated, horizontal sealing bar 148 comes down and engages the upper edges of the closure strip and bag film to seal the bag.

Figure 18:
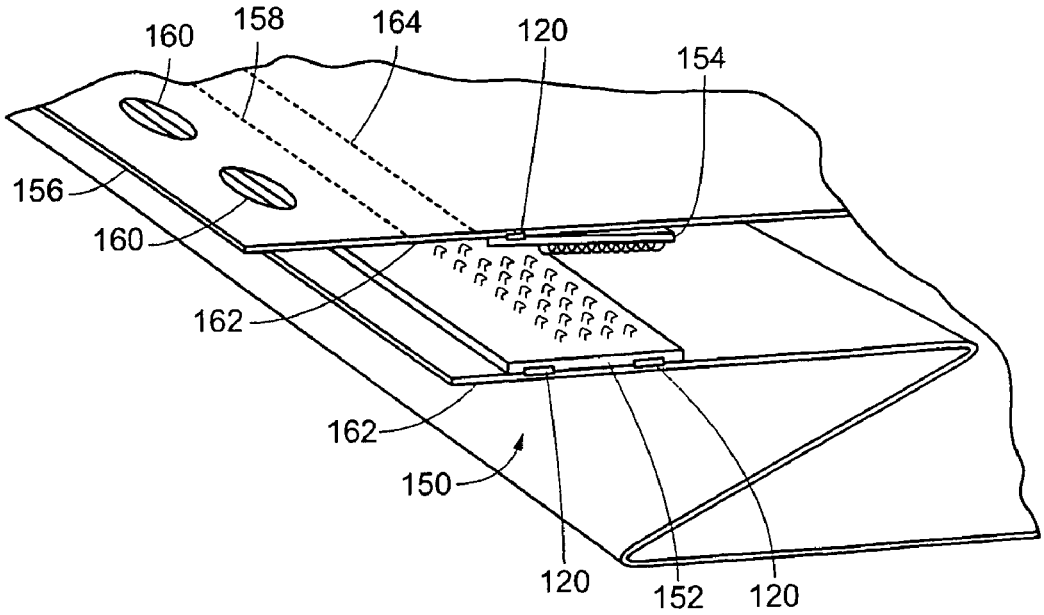
FIG. 18 is a cut-away view through an open, gusseted end of a bag having a two-part closure and a wicket extension.

FIG. 18 shows a closure structure for bags that are to be filled through the closure, rather than between the closure and bag film. Closure 150 consists of two separate strips, a hook strip 152 and a loop strip 154. The two strips may be produced as a single closure strip and subsequently split into the two strips, if desired. Hook strip 152 is bonded to the bag film along its two edges by heat seals 120. Loop strip 154 is only attached along its outer edge by a single continuous heat seal 120, leaving the edge of the loop strip facing into the bag tube free as shown. The hook and loop strips are aligned with each other such that their mating arrays of loops and hooks will engage under light pressure to reclose the bags formed of this precursor bag film and closure assembly. The outer edge the bag film has a wicket extension 156 of perhaps 1.5 to 2.0 inches (37 to 50 millimeters) in width and joined to the rest of the bag film along a series of perforations 158. Extension 156 defines a series of through holes 160 for engagement by wickets. In some cases, holes 160 are equally spaced along the bag film tube for engagement by a tractor wheel during processing. Perforations 158 enable the extension and its wicket holes to be severed from the rest of the bag film after processing. Adjacent extension 156 is a weld flange 162 outboard of closure 150 and of a width sufficient for sealing the two outer edges of the bag film together. Another series 164 of perforations or a weakened tear line may be included to enable the sealed weld flanges 162 to be torn from the rest of the bag film to access closure 152 after retail sale, for initial opening, so as to provide the bag with a tamper-evident tear strip.

Figure 19:
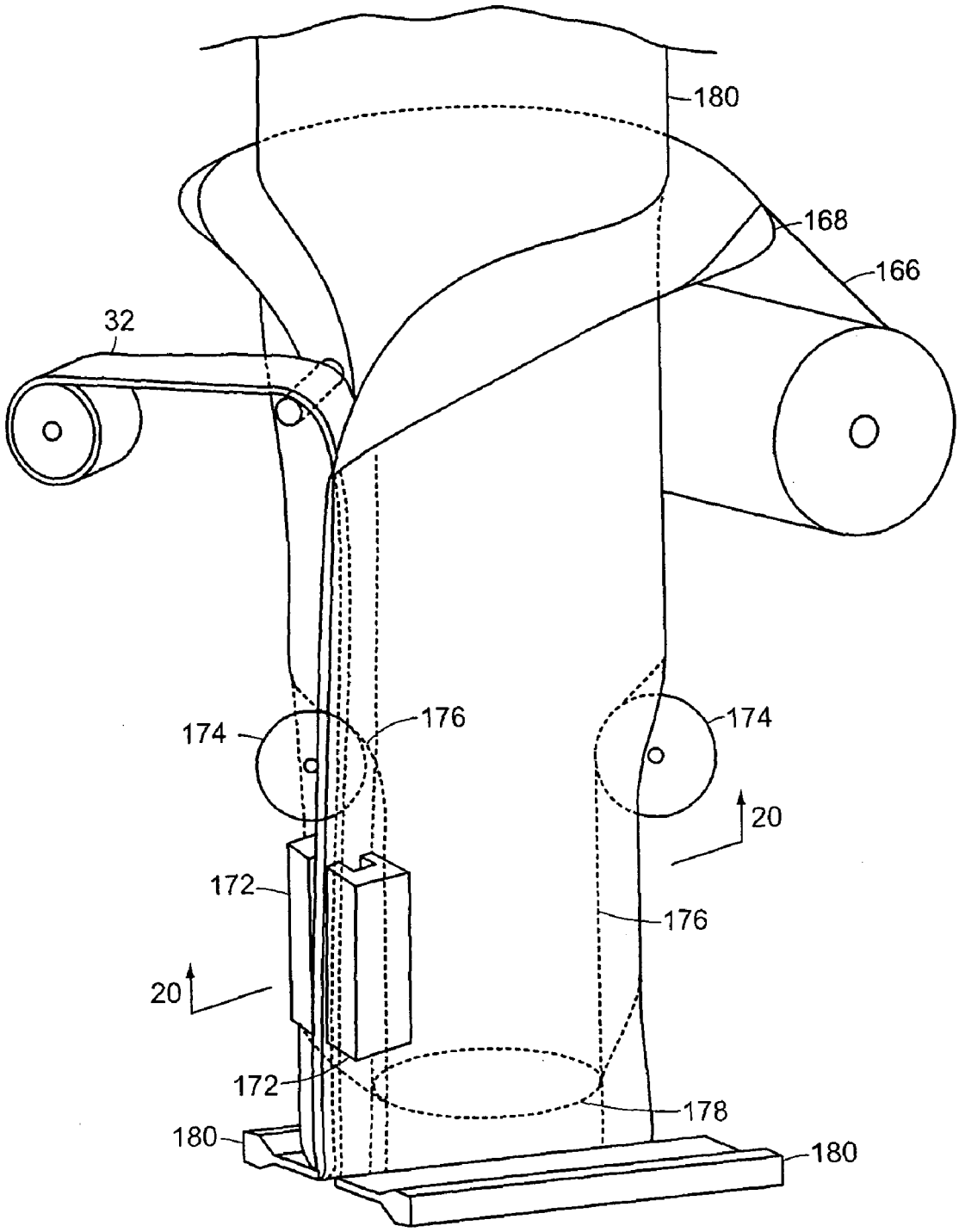
FIG. 19 shows a vertical form, fill and seal method and apparatus.
Figure 20:
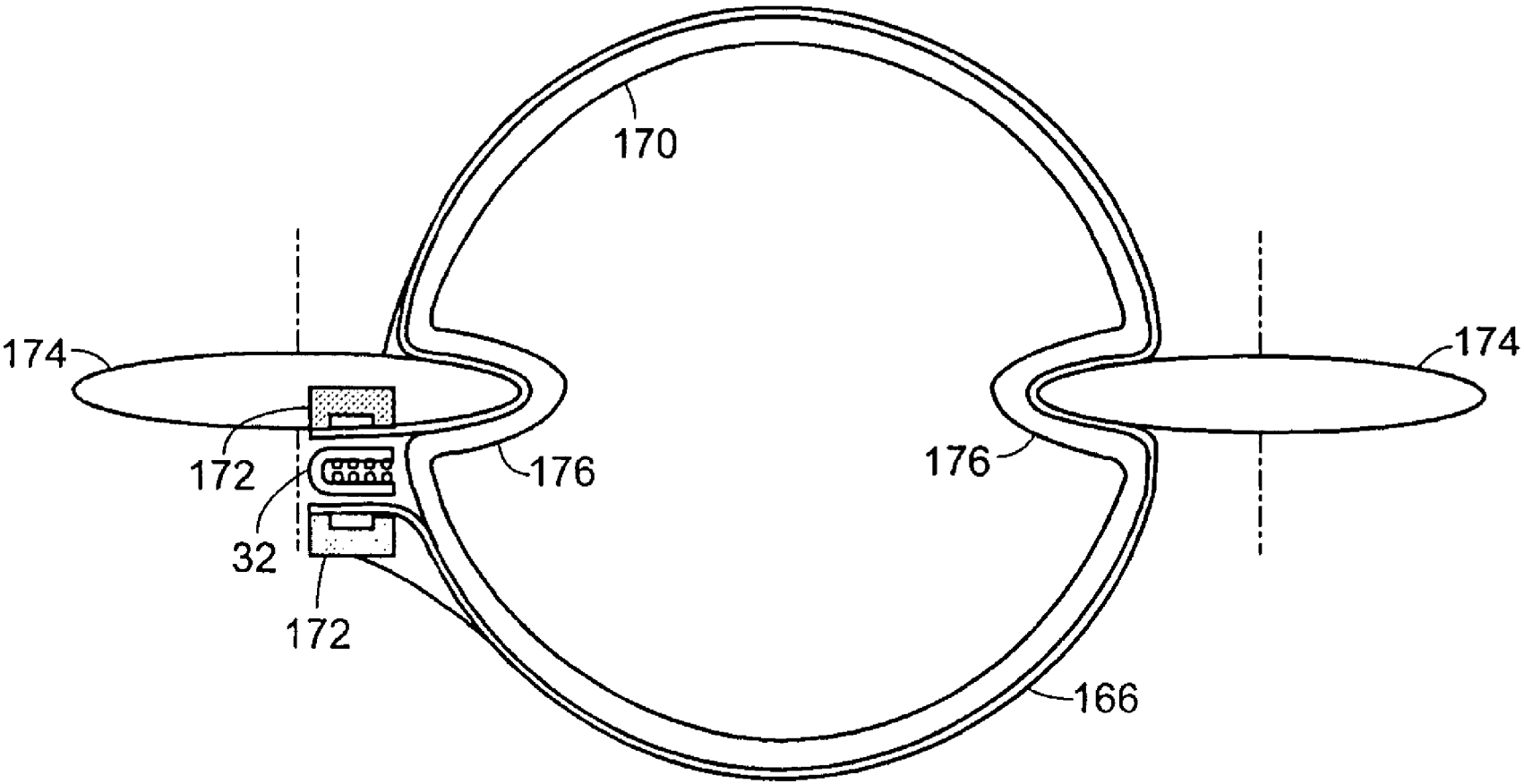
FIG. 20 is a cross-sectional view, taken along line 20—20 in FIG. 19.

FIGS. 19 and 20 illustrate a vertical form-and-fill operation in which a folded continuous length of closure strip 32 is introduced between the facing edges of bag film 166 advanced about a forming collar 168 onto a fill tube 170. As the closure strip and bag film edges are sealed between seal bars 172, two gusset wheels 174 direct the bag film into two opposing grooves 176 in opposite sides of the fill tube, one of the grooves and gusset wheels located adjacent the seal flange containing the closure strip. Immediately below the lower end 178 of the fill tube, twin lateral sealing bars 180 come together at fixed time/length intervals to seal across, and cut through, the bag film and closure strip to form individual, sealed, filled bags. As bars 180 come together they secure the gusset folds created by wheels 174 at the top of a filled bag below bars 180, and secure the bottom ends of the gusset folds of the next bag to be filled, above bars 180. In some cases, bars 180 form two lateral seals and incorporate a cutting bar to cut through the bag film between the seals.

Wicketed, gusseted bags having the reclosable closure as shown in FIG. 18 can also be filled in a horizontal filling process (not shown), such as one in which the contents are inserted through a spring-loaded duck bill insertion tube. Such bags can be received as a wicketed stack as known, for example, in the packaging of bread and the like. The top bag of the stack is air inflated, and the force of over-inserting the product rips the bag from the wicket. In some cases, the product may be inserted without tearing the bag from the wicket, the closure can be closed and the weld flanges 162 sealed together to seal the bag while the bag is yet on the wicket. Then, the wicket extension 156 can be torn from the bag along line 158, or can be slit from the bag during sealing. Such a filling method and bag structure is useful for packaging frozen food items, such as fish sticks and waffles and the like, as the hook and loop bag closure functions well as a repeat closure under very cold conditions as are found in freezers (where some adhesives exhibit some deterioration of function), and also continue to close through crumbs and other debris generated by repeated access to such contents.

The gusseted, reclosable bags discussed above can also be employed for packaging items in trays, such as coffee cakes and the like that are commonly packaged in boxes. The width of the bag between the side seals should be sufficient to enable the side seals to be displaced toward one another as the opening is extended to full height over a width sufficient to receive the product. After filling and sealing, the end gussets of such bags help to provide a box-like appearance for retail display. The aluminum trays in which such cakes are baked could have extended side panels to enable such packages to be stacked without damaging the goods, for example.

A number of embodiments of the invention have been described. Nevertheless, it will be understood that various modifications may be made without departing from the spirit and scope of the invention. Accordingly, other embodiments are within the scope of the following claims.

What is claimed is:

1. A gusseted bag, comprising a body having opposing broad face panels defining a volume therebetween for holding a quantity of contents, an end of the body forming an expandable gusset between the broad face panels; and a reclosable bag closure between a folding region of the expandable gusset and a corresponding adjacent edge region of one of the broad face panels, the closure comprising elongated, mating bands of hooks and hook-engageable fibers, the gusset folding region and the corresponding adjacent edge region of the broad face panel overlapping the bands of hooks and hook-engageable fibers, such that when the closure is opened a bag opening is formed between the expandable gusset and said one of the broad face panels of the bag, to access the bag contents, wherein the bag closure comprises a unitary, folded strip carrying the mating bands on a front face thereof, a back face of the folded closure strip defining one side of a fill opening.

2. The bag of claim 1 wherein the body has two opposing gussets between the broad face panels on opposite ends of the bag, the bag closure being disposed adjacent one of the gussets.

3. The bag of claim 2 wherein the opposing gussets are disposed at top and bottom ends of the bag, and wherein the bag is constructed to rest on its bottom end when filled.

4. The bag of claim 2 wherein the bag is constructed to rest on a bottom end thereof when filled, with the two opposing gussets disposed along opposite vertical sides of the bag.

5. The bag of claim 1 wherein the bag is constructed to rest on a bottom end thereof when filled.

6. The bag of claim 5 wherein the gusset and closure are disposed at a top end of the bag with the bag standing on its bottom end.

7. The bag of claim 5 wherein the gusset and closure are disposed along a vertical side edge of the bag with the bag standing on its bottom end.

8. The bag of claim 1 wherein the bag closure comprises a unitary strip-form base along which the mating bands extend in parallel, the base defining a frangible burst membrane between the mating bands, the membrane arranged to be breached to gain initial access to the bag contents.

9. The bag of claim 8 wherein the burst membrane is disposed inboard of the mating bands.

10. The bag of claim 1 wherein one longitudinal side of the closure is attached to the bag body only outboard of the mating bands.

11. The bag of claim 10 wherein said one longitudinal side of the closure is disposed adjacent said one of the broad face panels of the bag, an opposite longitudinal side of the closure being secured to the gusset.

12. The bag of claim 10 wherein said one longitudinal side of the closure comprises one of a hook strip and a loop strip, and an opposite longitudinal side of the closure comprises the other of the hook strip and the loop strip.

13. The bag of claim 1 wherein the bag body comprises two opposing weld flanges outboard of the bag closure and exposed to be sealed together after filling.

14. The bag of claim 13 wherein the bag body defines a frangible tear line along an inboard edge of at least one of the weld flanges, for tearing the weld flanges from the bag to access the contents after filling.

15. The bag of claim 1 further comprising a wicket extension along a free edge of one of the face panels outboard of the closure, the wicket extension defining at least one hole therethrough.

16. The bag of claim 1 wherein the gusset extends between sealed edges of the bag.

17. The bag of claim 16 wherein the bag closure also extends between the sealed edges of the bag.

18. A gusseted bag, comprising a body having opposing broad face panels defining a volume therebetween for holding a quantity of contents, an end of the body forming an expandable gusset between the broad face panels; and a reclosable bag closure between a folding region of the expandable gusset and a corresponding adjacent edge region of one of the broad face panels, the closure comprising elongated, mating bands of hooks and hook-engageable fibers, the gusset folding region and the corresponding adjacent edge region of the broad face panel overlapping the bands of hooks and hook-engageable fibers, such that when the closure is opened a bag opening is formed between the expandable gusset and said one of the broad face panels of the bag, to access the bag contents, wherein the bag closure comprises a unitary strip-form base along which the mating bands extend in parallel, the base defining a frangible burst membrane between the mating bands, the membrane arranged to be breached to gain initial access to the bag contents.

19. The bag of claim 18 wherein the burst membrane is disposed inboard of the mating bands.

20. A gusseted bag, comprising a body having opposing broad face panels defining a volume therebetween for holding a quantity of contents, an end of the body forming an expandable gusset between the broad face panels; and a reclosable bag closure between a folding region of the expandable gusset and a corresponding adjacent edge region of one of the broad face panels, the closure comprising elongated, mating bands of hooks and hook-engageable fibers, the gusset folding region and the corresponding adjacent edge region of the broad face panel overlapping the bands of hooks and hook-engageable fibers, such that when the closure is opened a bag opening is formed between the expandable gusset and said one of the broad face panels of the bag, to access the bag contents, wherein one longitudinal side of the closure is attached to the bag body only outboard of the mating bands.

21. The bag of claim 20 wherein said one longitudinal side of the closure is disposed adjacent said one of the broad face panels of the bag, an opposite longitudinal side of the closure being secured to the gusset.

22. The bag of claim 20 wherein said one longitudinal side of the closure comprises one of a hook strip and a loop strip, and an opposite longitudinal side of the closure comprises the other of the hook strip and the loop strip.

23. The bag of claim 20 wherein the body has two opposing gussets between the broad face panels on opposite ends of the bag, the bag closure being disposed adjacent one of the gussets.

24. The bag of claim 20 wherein the bag is constructed to rest on a bottom end thereof when filled.

25. The bag of claim 20 wherein the bag closure comprises a unitary strip-form base along which the mating bands extend in parallel, the base defining a frangible burst membrane between the mating bands, the membrane arranged to be breached to gain initial access to the bag contents.

26. The bag of claim 25 wherein the burst membrane is disposed inboard of the mating bands.

27. The bag of claim 20 wherein the gusset extends between sealed edges of the bag.

28. The bag of claim 27 wherein the bag closure also extends between the sealed edges of the bag.

* * * * *